United States Patent [19]

Lang et al.

[11] Patent Number: 4,800,735

[45] Date of Patent: Jan. 31, 1989

[54] FAN MOTOR ASSEMBLY METHOD AND APPARATUS FOR A ROOM AIR CONDITIONER

[75] Inventors: Richard D. Lang, Chittenango; Theodore S. Bolton, Liverpool, both of N.Y.

[73] Assignee: Carrier Corporation, Syracuse, N.Y.

[21] Appl. No.: 123,687

[22] Filed: Nov. 23, 1987

[51] Int. Cl.[4] ..... F25D 19/00

[52] U.S. Cl. ..... 62/298; 62/262

[58] Field of Search ..... 62/298, 262

[56] References Cited

U.S. PATENT DOCUMENTS 2,885,142 5/1959 Eberhart ..... 62/262 X

*Primary Examiner*—Henry A. Bennet

*Attorney, Agent, or Firm*—Dana F. Bigelow

[57] ABSTRACT

The intermediate partition of a room air conditioner is provided with a downwardly extending slot in its upper edge such that installation and removal of the motor, with its attached fans, can be easily accomplished without removal of the partition. A filler plate is provided for insertion into the slot after the motor has been installed into its mount in the outdoor section.

11 Claims, 5 Drawing Sheets

FAN MOTOR ASSEMBLY METHOD AND APPARATUS FOR A ROOM AIR CONDITIONER

BACKGROUND OF THE INVENTION

This invention relates generally to room air conditioners and, more particularly, to a method and apparatus for mounting a fan/motor assembly in a room air conditioner.

Room air conditioners comprise indoor and outdoor sections separated by a laterally extending wall or partition. Coils and associated fans are provided in each of the outdoor and indoor sections. Normally a single motor is provided to simultaneously drive both fans, and the motor is normally located in the outdoor section to thereby minimize the indoor noise. To accomplish this it is, of course, necessary for the motor shaft to pass through the partition such that the indoor fan can be attached thereto.

A typical process of installing a fan/motor assembly into a room air conditioner is first inserting the indoor shaft through a hole in the partition, fastening the motor either to the partition or the base pan, and then sliding the indoor fan over the shaft and locking it in place. This requires that the shaft flat or other locking means is properly aligned with the fan hub, a step which can be difficult when the fan is dropped in from the top, as is usually the case. Further, on the other end of the motor shaft the shroud and the condenser fan must then be installed after the motor is in place, with the reverse being required for removal of the motor where repair or maintenance is required. Thus, it will be seen that not only for the initial installation during the manufacturing process, but even more so when disassembly and reassembly is required for servicing, installation or removal of the motor can be difficult and involve other components. For example, in order to remove the motor, it is normally necessary to remove the partition with its attached scroll or, alternatively, to first remove the shroud and the outdoor and indoor fans, either of which is very time consuming.

Sometimes it is also necessary to pull the condenser coil out of the way, which in turn may cause damage to the tubing or cause the system to lose charge.

Another approach is to assembly the motor and the indoor fan to the partition before the partition is assembled to the base pan. If the reverse is used for servicing, the entire partition must then be removed to remove the motor. If this method is carried further such that the condenser fan and shroud are assembled to the motor/partition assembly, then both the partition and the shroud can be fastened to the base pan at the same time. Again, if this procedure is used in reverse for servicing, it is necessary to remove both the shroud and the partition in order to remove the motor for servicing. The installation and/or removal of the entire assembly can be cumbersome and difficult and even require the service of two people.

It is therefore an object of the present invention to provide an improved method of installing a motor in a room air conditioner.

Another object of the present invention is the provision in a room air conditioner for a motor/partition arrangement which allows removal of the motor without removal of the partition.

Yet another object of the present invention is the provision in a room air conditioner for easily installing and/or removing the fan motor without removing the outdoor fan shroud.

Still another other object of the present invention is the provision in a room air conditioner for a motor/partition combination which is simple in design, easy to install and effective in use.

These objects and other features and advantages become more readily apparent upon reference to the following description when taken in conjunction with the appended drawings.

SUMMARY OF THE INVENTION

Briefly, in accordance with one aspect of the invention, the intermediate partition wall of a room air conditioner is provided with a downwardly extending slot in its upper edge. Provision is made to install the motor, with its two fans attached to either end of its shaft, into the slot and to secure the motor to the base pan. In this way, the motor can be easily installed and/or removed without removing the partition. Further, the outdoor and indoor fans can be easily installed or removed while the motor is outside the assembly, where it is more accessible.

By another aspect of the invention, there is provided a filler plate which, after the motor is in place, can be easily installed into the slot to thereby complete the partition wall and isolate the outdoor section from the indoor section. For disassembly, the filler plate is first removed and then the motor, with attached fans and shroud, can be easily removed by lifting it upwardly through the slot.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
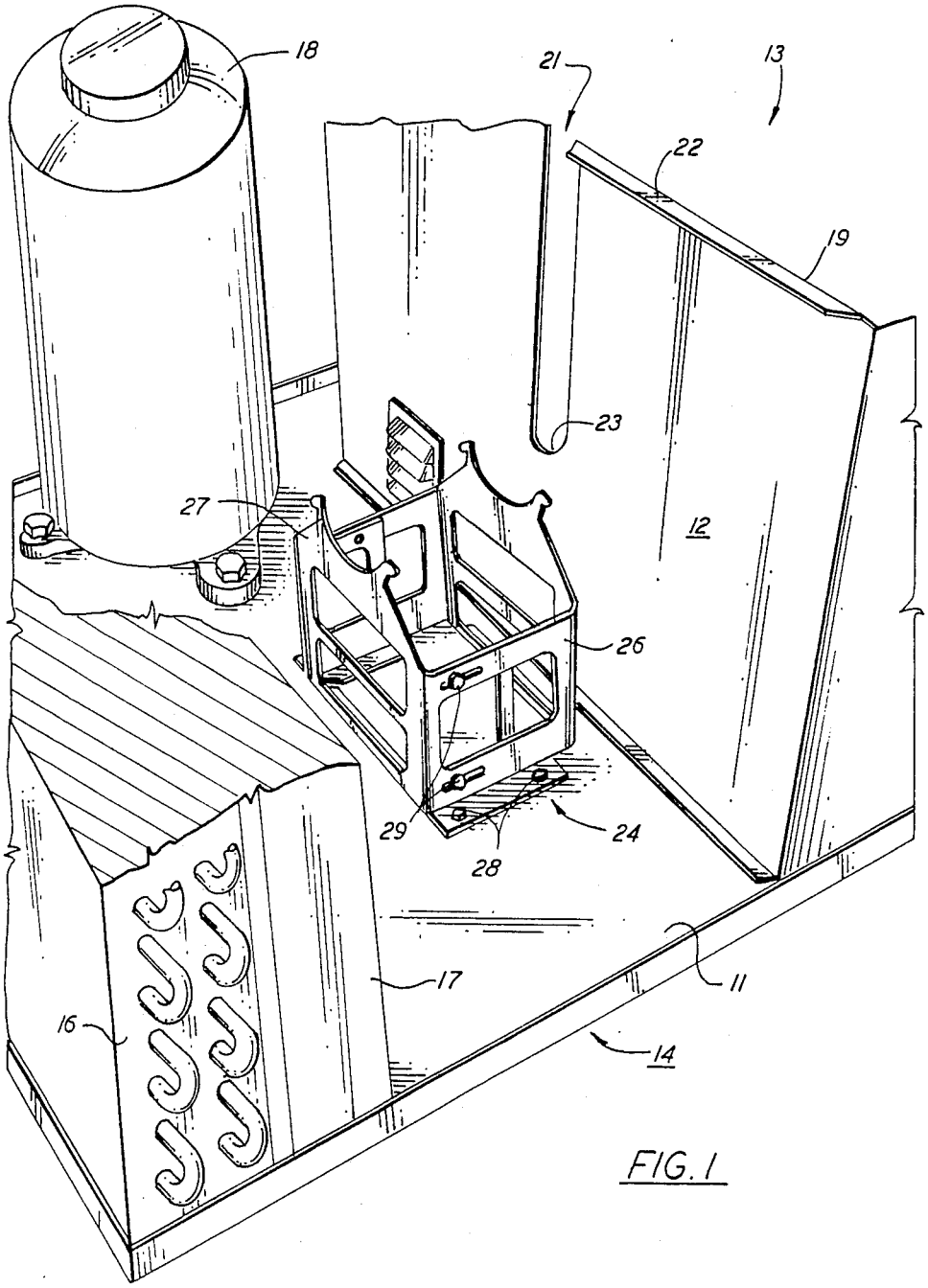
FIG. 1 is an air conditioner chassis showing the motor mount/installation assembly in accordance with the present invention.

Referring now to FIG. 1, the chassis of a room air conditioner is shown to include a base pan 11, and a partition 12 which separates an indoor section 13 from an outdoor section 14. The outdoor section 14 includes a coil 16 through which outside air is circulated by way of an outdoor fan disposed within a shroud structure 17. A compressor 18 is mounted to the base pan 11 and operates to provide the necessary energy in the refrigeration circuit in a conventional manner.

The indoor section 13 contains an evaporator coil and blower (not shown) which operate in a conventional manner to receive the relatively warm air from the room to be conditioned, cool the air as it passes through the evaporator coil, and then deliver the cool air to the room. Mounted in the indoor section 13, adjacent the partition wall 12, is a sound absorbing wall 19 which is provided to isolate the indoor section 13 from the sounds (principally from the compressor) in the outdoor section 14. Formed in the partition wall 12, and also in the sound absorbing wall 19 is a slot 21 extending downwardly from the top edge 22 of the partition wall 12 to an end point 23. The purpose of this slot 21 is to facilitate the easy installation and removal of the fan drive motor in a manner to be described hereinafter.

Located near the center of the base pan 11 is a motor mount assembly 24 comprising first and second mount members 26 and 27 The first mount member 26 is secured directly to the base pan 11 by way of fasteners 28, and the second mount member 27 is connected to the first mount member 26 by fasteners 29 in a manner which allows selective adjustment of the position of the second mount member 27 in order to accommodate various size motors between the end walls of the mount members 26 and 27.

Figure 2:
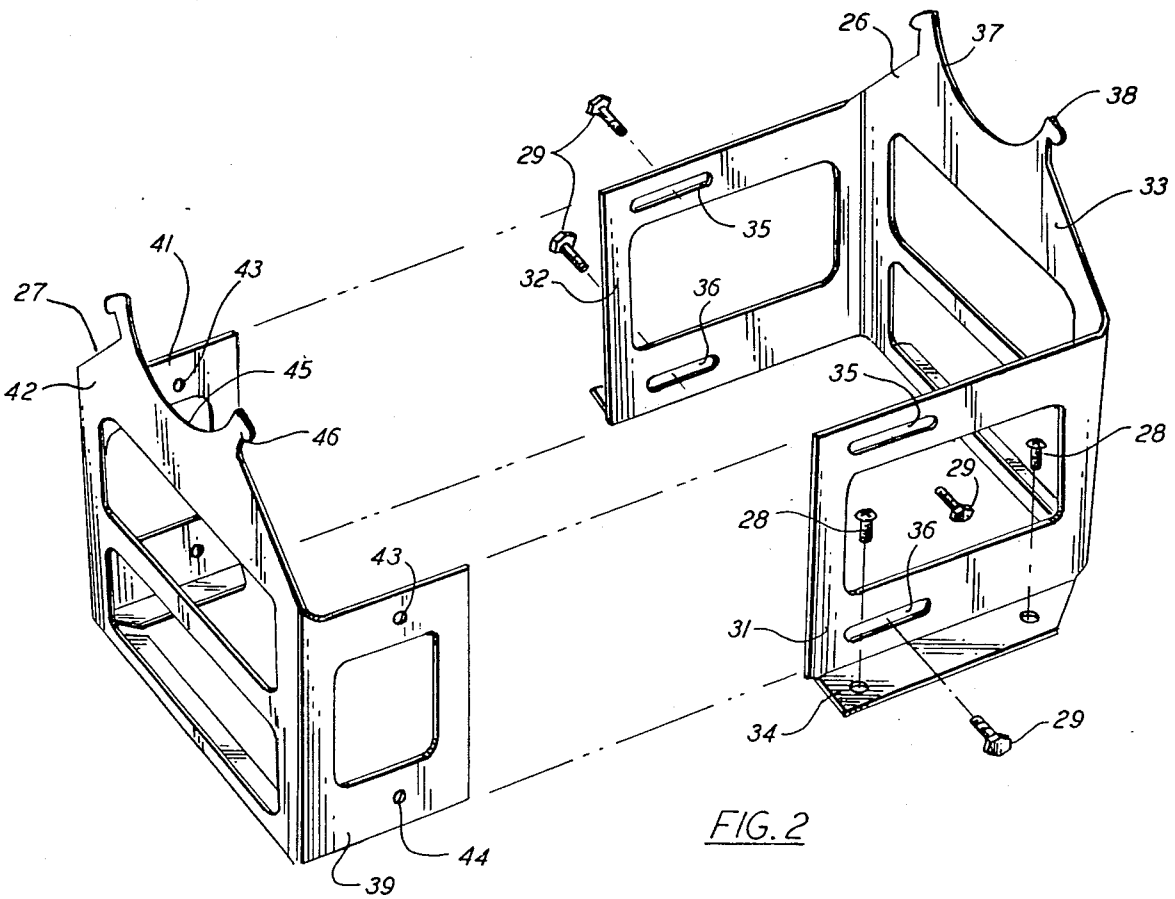
FIG. 2 is a partial enlarged view of the motor mount portion thereof.

Referring now to FIG. 2, the motor mount structure 24 is shown in exploded form. The first mount member 26 comprises upstanding side walls 31 and 32 interconnected by the upstanding end wall 33. The side walls 31 and 32 each have a bottom flange 34 extending outwardly for securing the first mount member 26 to the base pan 11. A pair of narrow, horizontally extending slots 35 and 36 are provided in each of the side walls 31 and 32 for interconnecting the second motor mount 27 to the first motor mount 26 in a manner which allows for selectively adjusting the overlap in a manner to facilitate various lengths of drive motors to be supported between the first and second motor mount members. The end wall 33 has at its upper edge a semi-circular shaped cradle structure 37 with projecting ears 38 on either side thereof. The cradle structure 37 is adapted to supportably receive one end of the drive motor thereon, and the ears 38 are adapted to receive and retain a securing clip thereon as shown in FIG. 4.

The second mount member 27 includes side walls 39 and 41 interconnected by an end wall 42. The side walls contain upper and lower holes, 43 and 44, respectively, which register with the slots 35 and 36, respectively, in such a manner as to permit the selective positioning of the second mount member 27 so that the respective end walls 33 and 42 are properly spaced for a particular motor length within a range of sizes. The fasteners 29 are used to secure the second mount member 27 to the first mount member 26. Similar to the structure of the first mount member end wall 33, the end wall 42 includes a cradle structure 45 having ears 46 on either side thereof for securing the motor in place after installation.

Figure 3:
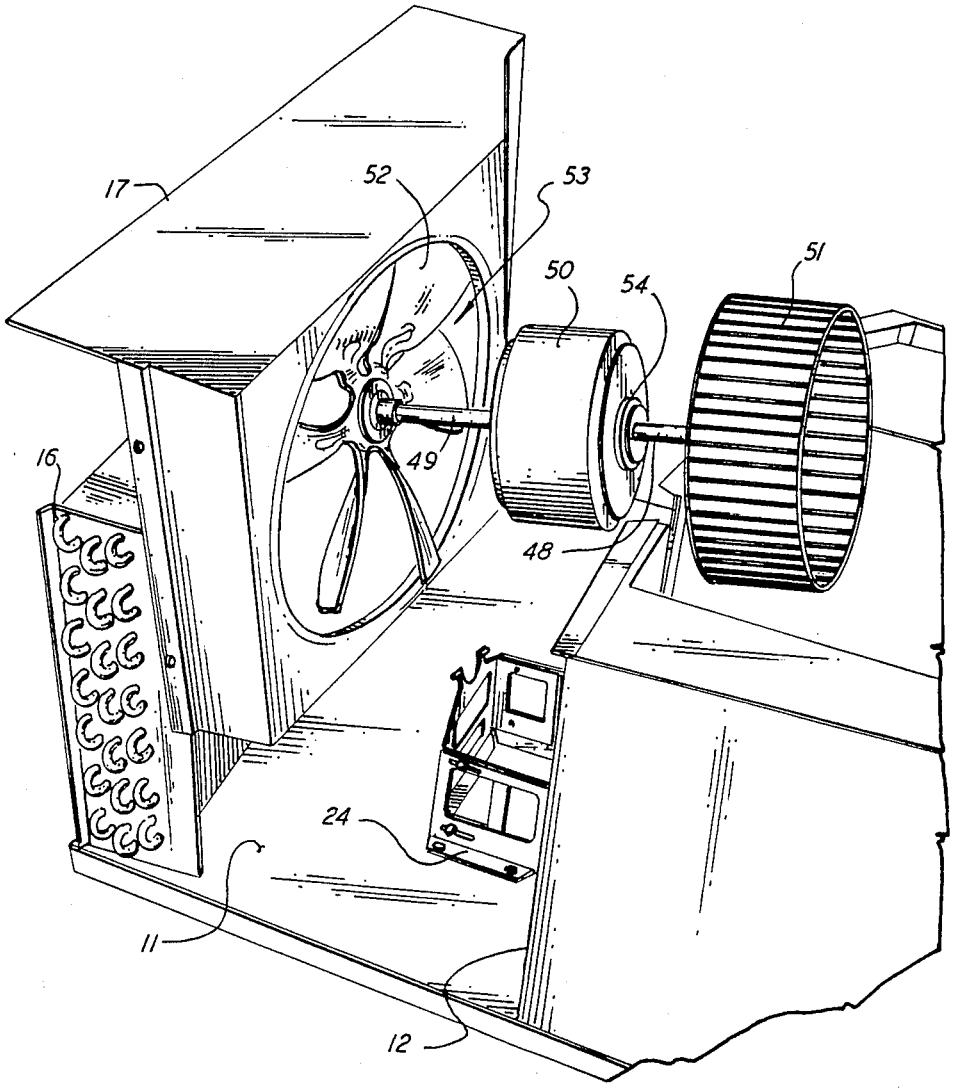
FIG. 3 is a perspective view of the motor and fan assembly in the process of installation.

Assuming now that the slot 21 has been formed in the partition Wall 12, and that the motor mount assembly 24 has been secured in place and properly adjusted for the desired length between end walls, let us consider the next step in the assembly process. As shown in FIG. 3, the motor 50 includes shaft ends 48 and 49 driven by a common rotor. As part of the assembly process, a blower wheel 51 is attached to the shaft end 48, the fan shroud 17 is placed over the shaft 49, and the condenser fan 52 is connected to the shaft end 49 as shown. That assembly is then inserted into the chassis with the shaft end 48 being inserted into the slot 21 of the partition wall 12, with the blower wheel 51 being placed just forward of the partition wall 12 in substantial parallel relationship therewith. To accommodate the mounting of the motor within the mount assembly 24, a pair of vibration dampers in the form of resilient (e.g. molded rubber) rings 54 are provided at the ends of the motor 50, one being attached to the shaft end 48 and the other being attached to the shaft other end 49 as shown in FIG. 3. The rings 54 have an annular groove around their outer edge, with the rings and grooves being sized so as to fit snugly into the cradle structures 37 and 45 of the mount assembly end walls.

Figure 4:
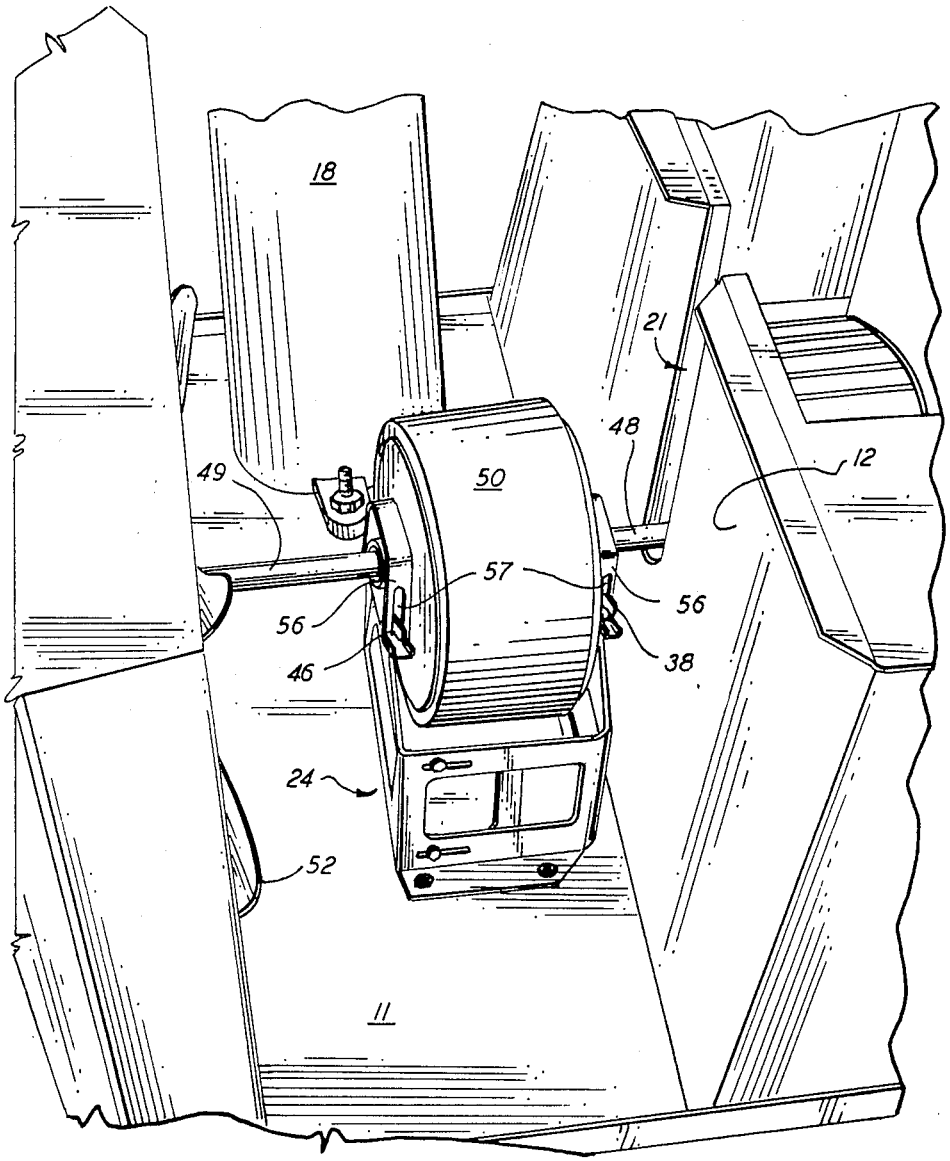
FIG. 4 is a perspective view of the motor securing clip in the process of installation.

After the motor assembly has been so installed into the mount assembly 24, a U-shaped clip 56 is installed on each end of the motor 50 as shown in FIG. 4 by slightly expanding the U-shaped clip over the ears 38 and 46, respectively until the edges of the ears fit into the openings 57 of the clip to thereby allow it to spring back to a closed position to thereby secure the motor 50 in place.

Figure 5:
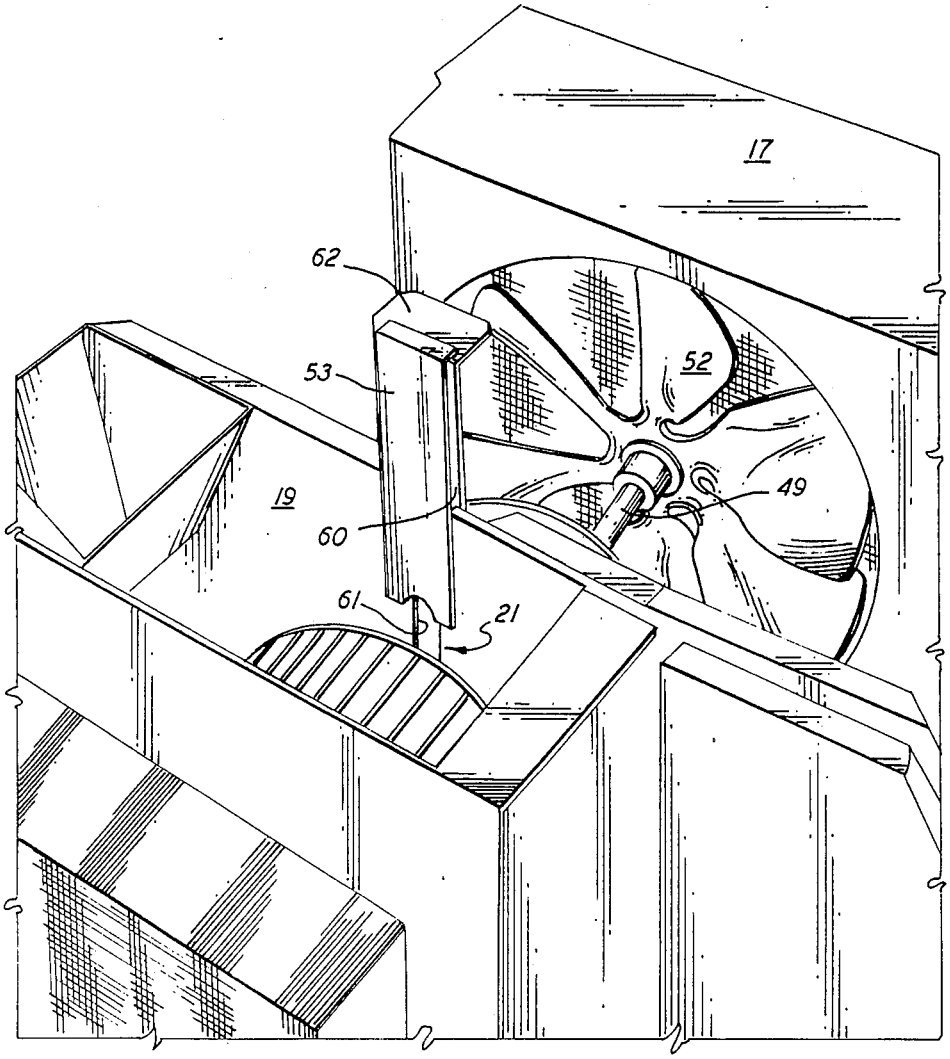
FIG. 5 is a perspective view of the filler panel in the process of assembly.

It should be recognized that the partition wall 12 functions to isolate the outdoor section from the indoor section with regard to air flow, as well as isolating the indoor section from the noise in the outdoor section. It further provides strength to the assembly. Thus, it is necessary to close the slot 21 by way of a filler plate 58 as shown in FIG. 5. The filler plate 58 is installed from the top down by sliding the grooved edges 60 over corresponding tongue shaped edges of the slot 21 until the lower edge 61 of the filler plate rests on a scroll surface at the lower edge of the slot 21. The filler plate lower edge 61 preferably includes a semi-circular form which fits closely around the motor shaft end 48. At the top end of the filler plate 58, a flange 62 is provided for connection to a reinforcement member which may be connected between the filler plate 58 and the shroud structure 17 to reinforce the assembly.

It will be recognized that the inventive structure is easily assembled as described hereinabove. It should also be recognized that disassembly can be accomplished in a very simple manner by reversing the process. In this way, a complete motor assembly may be installed or removed without disrupting either the outdoor or indoor fan and/or the indoor scroll (not shown).

While the present invention has been disclosed with particular reference to a preferred embodiment, the concepts of this invention are readily adaptable to other embodiments, and those skilled in the art may vary the structure thereof without departing from the essential spirit of the present invention.

What is claim is:

1. In a room air conditioner of the type having a base pan and indoor and outdoor sections separated by a partition and having a motor for driving an indoor fan, an improved motor mounting arrangement comprising:

a motor mount fixture for supporting the motor in the outdoor section adjacent the partition;

a slot opening formed in the partition and extending downwardly from the top edge thereof to a point adjacent said motor mount fixture to accommodate the downward insertion of a motor into said motor mount fixture with the motor shaft extending through said slot to the indoor section; and a filler plate adapted to be inserted into said slot opening to close said opening between the outdoor and indoor sections.

2. The motor mounting arrangement as set forth in claim 1 wherein the motor is adapted to also be drivingly connected to an outdoor fan.

3. A motor mounting arrangement as set forth in claim 2 wherein the outdoor fan is drivingly attached to the opposite end of the drive shaft from that which drives the indoor fan.

4. The motor mounting arrangement as set forth in claim 1 wherein said filler plate is inserted into said slot by way of a tongue and groove arrangement.

5. The motor mounting arrangement as set forth in claim 4 wherein the tongue portion is formed at the edge of the slot and the groove is formed in the edges of the filler plate.

6. A method of installing a motor into an air conditioner of the type having outdoor and indoor sections separated by a partition and having a motor mounted in the outdoor section for driving a fan in the indoor section comprising the steps of:

installing a motor mount fixture in the outdoor section adjacent the partition;

forming a slot opening in the partition extending downwardly from the top edge thereof to a point adjacent said motor mount fixture;

inserting the motor downwardly into said motor mount with the motor shaft passing through said slot and into the indoor section; and inserting a filler plate into said slot opening to close said opening between the outdoor and indoor sections.

7. The method of installing a motor as set forth in claim 6 and including the step of securing the motor in said motor mount.

8. The method of installing a motor as set forth in i claim 6 and including the step of attaching an indoor blower wheel to the shaft of the motor prior to inserting the motor into said mount.

9. The method of installing a motor as set forth in 1 claim 6 wherein the motor is adapted to simultaneously drive a fan in the outdoor section and including the step of attaching an outdoor fan to the motor shaft.

10. The method of installing a motor as set forth in claim 9 wherein said outdoor fan is attached to the motor shaft prior to inserting the motor into said mount.

11. The method of installing a motor as set forth in claim 10 wherein the outdoor section includes a fan shroud structure and wherein said outdoor fan attachment step is preceded by the step of installing said fan shroud over said motor shaft.

* * * * *